US010423177B2

(12) United States Patent
Fiocchi et al.

(10) Patent No.: US 10,423,177 B2
(45) Date of Patent: Sep. 24, 2019

(54) FEEDBACK BASED LEVEL SHIFT REGULATOR CIRCUIT WITH IMPROVED STABILITY

(71) Applicant: ams AG, Unterpremstaetten (AT)

(72) Inventors: Carlo Fiocchi, Belgioioso (IT); Monica Schipani, Pisa (IT)

(73) Assignee: ams AG, Unterpremstaetten (AT)

( * ) Notice: Subject to any disclaimer, the term of this patent is extended or adjusted under 35 U.S.C. 154(b) by 0 days.

(21) Appl. No.: 16/062,599

(22) PCT Filed: Nov. 18, 2016

(86) PCT No.: PCT/EP2016/078156
§ 371 (c)(1),
(2) Date: Jun. 14, 2018

(87) PCT Pub. No.: WO2017/102251
PCT Pub. Date: Jun. 22, 2017

(65) Prior Publication Data

US 2018/0373281 A1 Dec. 27, 2018

(30) Foreign Application Priority Data

Dec. 15, 2015 (EP) ..... 15200060

(51) Int. Cl.
*G05F 1/575* (2006.01)
*G05F 1/46* (2006.01)

(52) U.S. Cl.
CPC ..... *G05F 1/575* (2013.01); *G05F 1/462* (2013.01); *G05F 1/465* (2013.01)

(58) Field of Classification Search
CPC ..... G05F 1/46
See application file for complete search history.

(56) References Cited

U.S. PATENT DOCUMENTS 5,551,075 A * 8/1996 Caux ..... H04B 1/18 330/277
5,798,673 A * 8/1998 Griffith ..... H03F 3/3067 330/255

(Continued)

FOREIGN PATENT DOCUMENTS

JP 2001-027910 A 1/2001

OTHER PUBLICATIONS

Hyogo, A. et al.: "A design of novel nVT level shift circuits using MOSFETs" IEICE Transactions onFundamentals of electronics, Communications and Computer Sciences E77-A Feb. 1994, No. 2, Tokyo, JP; pp. 394-397.

(Continued)

*Primary Examiner* — Jue Zhang
*Assistant Examiner* — Trinh Q Dang
(74) *Attorney, Agent, or Firm* — Fish & Richardson P.C.

(57) ABSTRACT

A level shift regulator circuit comprises a level shift transistor (Mls) and an output transistor (Mreg) being arranged in series to the level shift transistor (Mls) in an output path (OP). The circuit comprises a feedback path (FP) being arranged between an input node (IN) of the output path (OP) and a gate connection of the output transistor (Mreg). A current splitter (CS) is provided to split a current of a current source (IS0) coupled to the input node (IN) to reduce the loop gain. A current mirror (CM) is arranged in series to the current splitter (CS) to reduce the signal current provided by the current splitter (CS) to the gate connection of the output transistor (Mreg) to further reduce the gain and to improve stability of the circuit. A first and second filter (F1, F2) may optionally be provided to improve the phase response.

13 Claims, 8 Drawing Sheets

(56) References Cited

U.S. PATENT DOCUMENTS

| | | | | |
|---|---|---|---|---|
| 6,084,475 | A * | 7/2000 | Rincon-Mora | H03F 1/086 327/112 |
| 6,084,477 | A * | 7/2000 | Corsi | H03F 3/3008 330/264 |
| 7,468,615 | B1 | 12/2008 | Tan et al. | |
| 2009/0237068 | A1 * | 9/2009 | Vora | G01R 21/10 324/76.11 |

OTHER PUBLICATIONS

Aggarwal, B. et al.:"A low voltage wide swing level shifted FVF based current mirror" 2013 International conference on advances in computing, Communications and Informatics (ICACCI), IEEE, Aug. 22, 2013, pp. 880-885, XP032510303, ISBN: 978-1-4799-2432-5.

Okamura, L. et al.: "An automatic source/body level controllable 0,5V level SOI circuit technique for mobile and wireless network appplications" Communications and Information technologies, 2006. International Symposium on, IEEE, Oct. 1, 2006. pp. 771-774, XP031068434, ISBN: 978-0-7803-9740-8.

* cited by examiner

FEEDBACK BASED LEVEL SHIFT REGULATOR CIRCUIT WITH IMPROVED STABILITY

TECHNICAL FIELD

A level shift regulator circuit in a feedback based configuration is disclosed.

BACKGROUND

Continuous time voltage regulators are quite popular today. Starting from a DC/DC converter, adopted for its superior efficiency performance, they provide a ripple-free power supply for a load circuit. This means that parameters like accuracy and PSRR are key features for this block as well as low power consumption. A continuous time regulator can be implemented accordingly to different requirements: either source or sink capability (usually not both), regulated voltage referenced to either GND or supply, possible low voltage drop between the regulated voltage and the supply or ground.

Among the possible implementations, with some dynamic range limitation, the so called capless approach is popular. It is based on a level shift and adopts a local feedback to reduce the output impedance and improve the load regulation performance. A low impedance node that drives the load is the major feature of this kind of solution. In this way, the output pole can be thought of as non-dominant making a load capacitor unnecessary. This gives a remarkable advantage in case the required regulated voltage is adopted for internal chip references, saving one pin where an external stabilizing capacitor is located. The capacitance of the capacitor is usually in the order of about hundreds nF that is too large to be integrated.

It is a desire to provide a level shift regulator circuit that has only a small area consumption and provides a high stability.

SUMMARY

According to an embodiment of a level shift regulator circuit having improved stability, the circuit comprises a terminal to apply a supply potential and a current source to provide a constant current. The circuit further comprises a level shift transistor being connected to the current source and an output transistor being arranged in series to the level shift transistor. The circuit further comprises a current splitter to split the current of the current source, wherein the current splitter is connected to the gate connection of the output transistor. The circuit further comprises a current mirror being arranged in series to the current splitter, wherein the current mirror is coupled to the gate connection of the output transistor.

Further embodiments of the level shift regulator circuit are specified in the claims.

The level shift transistor and the output transistor may be arranged in an output current path. The circuit provides the output voltage at an output terminal between the source connection of the level shift transistor and the drain connection of the output transistor. A current source is provided to provide a current to an input node of the output current path. The current splitter may comprise a first transistor and a second transistor that are arranged in two parallel paths. The two parallel paths are connected between the input node of the output current path and a terminal to apply a ground potential.

The current splitter splits the current that reaches the current splitter from the current source between a first one of the parallel paths and a second one of the parallel paths. The first one of the parallel paths may comprise the first transistor of the current splitter and the second one of the current paths may comprise the second transistor of the current splitter. The current that reaches the current splitter is split by the first and the second transistor of the current splitter according to their geometrical ratio.

The drain connection of the first transistor of the current splitter is connected to the gate connection of the output transistor to provide a closed feedback loop. That means that only the current provided by the first transistor of the current splitter reaches the gate connection of the output transistor, if the second transistor of the current splitter would discharge to ground. This results in a gain reduction of the circuit. As a consequence the stability of the circuit is increased and a capacitance of a compensating capacitance being arranged between the gate connection of the output transistor and the output terminal/drain connection of the output transistor may be reduced.

The current mirror may be arranged in the second one of the parallel current paths. The current mirror may comprise a first and a second transistor that are connected to each other at a common gate connection. The drain connection of the second transistor of the current splitter is connected to the common gate terminal of the first and second transistor of the current mirror. The current mirror is configured to provide a current to the gate connection of the output transistor, wherein said current has an opposite sign than the signal current provided to the gate connection of the output transistor by the first transistor of the current splitter.

As a consequence, the current provided by the current mirror is subtracted from the current provided from the first transistor of the current splitter. That means that a further gain reduction is obtained, and in the end, this further gain reduction results in a much better stability of the circuit.

According to a further embodiment of the level shift regulator circuit, a first filter may be added in the current mirror. The first filter may be configured as a RC-filter. The addition of the first filter in the second one of the parallel paths prevents the gain reduction starting from the RC time constant cut off frequency. The first filter enables to generate a zero in the transfer function of the level shift regulator circuit to improve its phase response.

According to a further improved embodiment of the level shift regulator circuit, a second filter may be added to the current splitter regardless whether the first filter is applied to the circuit or not. The second filter may be configured as a RC-filter. The addition of the second filter bypasses the current splitter to let the incoming current reach the dominant pole with no attenuation. The second filter enables to generate a zero in the transfer function of the level shift regulator, starting from the time constant of the second filter that improves the phase response of the structure.

Starting from the loop gain analyses, the two additional blocks inserted in the feedback loop of the level shift regulator circuit allow to reduce the loop gain of the loop comprising the output transistor, the level shift transistor and the first transistor of the current splitter. The proposed circuit design significantly improves the stability of the structure. Using the optional first and second filter to bypass the action of the current splitter and the current mirror at high frequency allows to generate zeroes in the transfer function. This advantageously provides a larger phase margin that strengthens the stability of the structure and is capable of leaving a large degree of freedom to a designer for a more robust solution, unless more current is dissipated. The two proposed solutions, i.e. the current splitter and the current mirror as the first solution on the one hand and the filters to bypass the current mirror and the current splitter on the other hand, can be implemented either separately or together.

The current splitter and the current mirror used in the level shift regulator circuit allow to reduce the loop transconductance while preserving the same value for the transconductance of the output transistor. This gives a desired degree of freedom to separate the second pole from GBW (product of gain and bandwith/zero dB crossing point) so that the same phase margin can be obtained with a smaller size of a compensating capacitor being arranged between the gate connection of the output transistor and the output terminal of the level shift regulator circuit. Moreover, as a further optional step, the insertion of some reasonably small RC groups to bypass (partially and/or entirely) the action of the current splitter and the current mirror above a given frequency provides some doublets (zero-pole pairs) in the transfer function of the circuit to advantageously generate a positive phase shift to improve the loop transfer function in a pretty wide frequency range.

DETAILED DESCRIPTION

The proposed level shift regulator circuit will now be described in more detail hereinafter with reference to the accompanying drawings showing different embodiments of the level shift regulator circuit. The level shift regulator circuit may, however, be embodied in many different forms and should not be construed as limited to the embodiments set forth herein; rather, these embodiments are provided so that the disclosure will fully convey the scope of the level shift regulator circuit to those skilled in the art. The drawings are not necessarily drawn to scale but are configured to clearly illustrate the structure of the level shift regulator circuit.

Figure 1:
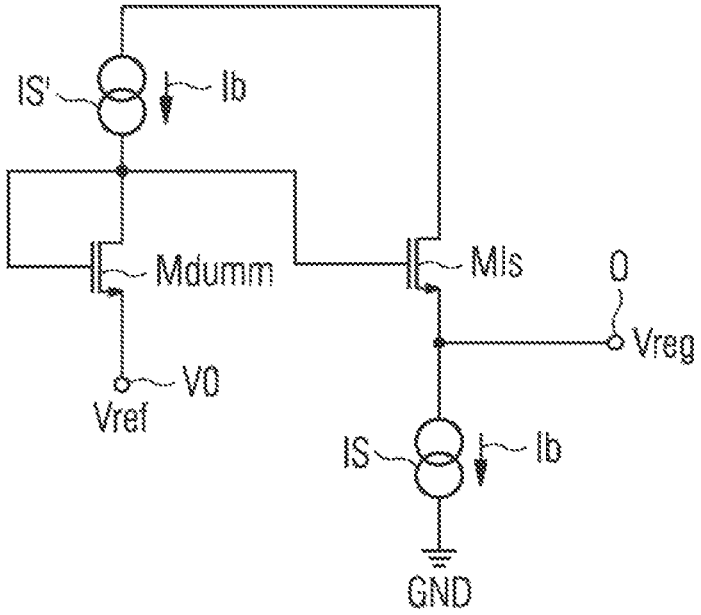
FIG. 1 shows an embodiment of a simple design of a level shift regulator circuit.

FIG. 1 shows a level shift based solution for voltage regulation. The circuit comprises a level shift element Mls that may be configured as a transistor. The transistor Mls is coupled via a constant current source IS to provide a current Ib to a ground potential GND. The level shifter comprises a reference terminal V0 to apply a reference voltage Vref. A diode Mdumm is connected to the reference terminal V0. The level shift transistor Mls is connected via a constant current source IS' to provide the current Ib to the diode Mdumm. An output voltage Vreg is generated at an output terminal O of the circuit.

The conceptual solution shown in FIG. 1 is quite straightforward. The diode Mdumm, matched to the level shifter Mls, shifts the reference voltage Vref of a nominally equal drop so that the output voltage Vreg equals the input reference voltage Vref. The level shifter of FIG. 1 has several drawbacks. The drops of the level shift transistor Mls and the dummy diode Mdumm match only in case of a given load current. Clearly, a poor load regulation results and this is often not acceptable.

Figure 2:
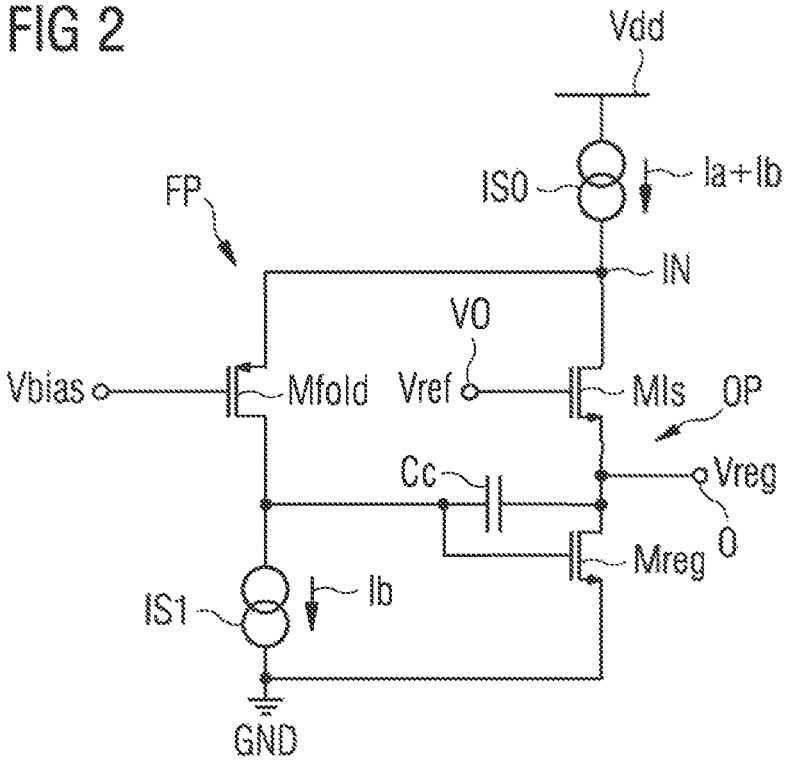
FIG. 2 shows an embodiment of a feedback based level shift regulator circuit.

FIG. 2 shows an embodiment of a feedback based level shift regulator circuit. The circuit comprises the level shift element Mls and a current generator Mreg. Both of the level shift element and the current generator may be embodied as a respective transistor, for example as a level shift transistor Mls and an output transistor Mreg. The circuit comprises a reference terminal V0 to apply the reference voltage Vref to a gate connection of the level shift transistor Mls. The level shift transistor Mls and the output transistor Mreg are connected in series in an output path OP between an input node IN of the output path and a ground potential GND. A compensating capacitor Cc is arranged between the gate connection of the output transistor Mreg and the output terminal O. The circuit comprises a constant current source IS0 to provide a constant current Ia+Ib to the input node IN.

The level shift regulator circuit comprises a feedback loop comprising a folding transistor Mfold that is biased at its gate terminal with a bias voltage Vbias. The drain connection of the folding transistor Mfold is connected to the gate connection of the output transistor Mreg. The drain connection of the folding transistor Mfold is connected via a constant current source IS1 to a ground potential GND.

A loop is closed once the sensed signal current in the transistor Mls, the level shift element, is collected by the folding transistor Mfold and driven to the gate connection of the current generator Mreg having sinking capabilities. The structure works as a current sinker. The gate connection of the level shift transistor Mls is biased by the reference voltage Vref. The dummy diode Mdumm for the Vref level shift is omitted in the drawing only for sake of simplicity. If by chance a change in the current at the output terminal O occurs, the current across the level shift transistor Mls will tend to change and there is also a change of the current flowing through the folding transistor Mfold. The current change in the current path of the folding transistor Mfold changes the voltage at the gate of the output transistor Mreg. The output transistor Mreg changes the current in order to counteract the current across the level shift transistor Mls. As a result, the transistor Mls will be more or less forced to drive always the same current. The feedback loop works to keep the level shift transistor Mls biased by a constant current Ia.

The level shift element Mls has a fixed bias current Ia and the load current is tracked by the current generator Mreg whose gate voltage is regulated by the feedback loop. The output impedance of the circuit structure is decreased by the loop gain and excellent load regulation results. It is worth noting that while the open loop level shift has one drive capability direction, the closed loop solution provides the opposite one.

Figure 3:
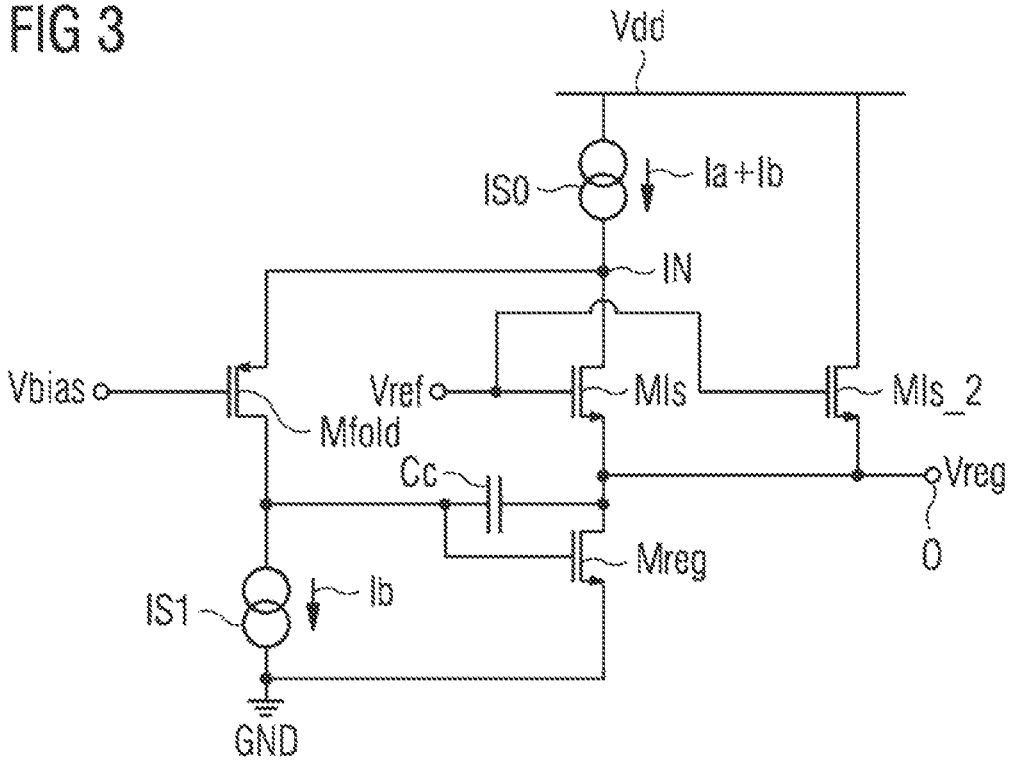
FIG. 3 shows an embodiment of a feedback based level shift regulator circuit with both source and sink capabilities.

FIG. 3 shows an embodiment of a feedback based level shift regulator circuit with both source and sink capabilities. A second level shift transistor Mls_2 of the open loop is put in parallel to the regulated level shift transistor Mls to make current drive capability symmetrical. The resulting load regulation remains nevertheless asymmetrical vs. the load current sign because the output impedance of the added level shift is not corrected by the loop gain. The addition of the second level shift transistor Mls_2, whose drain is at Vdd and not constrained by a current generator, allows theoretically unlimited source capability. Bias current in this device depends on Ia, the current in the level shift transistor Mls, and the aspect ratio relationship of the two transistors.

According to the circuit designs shown in FIGS. 1 to 3, currently the main focus is to exploit capacitor bootstrap to make fast a load variation response. A spike at the output is conveniently coupled to the internal current generators so that their current is accordingly increased for the duration of the spike itself. A static low power consumption follows while the spike reduction is guaranteed.

Anyhow, this technique is not capable of solving a common problem that makes the stability of the device quite critical in case of large load capacitor presence.

Even though this solution is potentially safe from the possibility of oscillation, because there are 3 poles in the circuit embodiment of FIG. 3, but the pole at the source of the folding transistor Mfold is at a very large frequency compared to the dominant pole at the gate of the output transistor Mreg, unfortunately the GBW and the second pole at the output node cannot be conveniently separated for all load conditions (current and capacitance), so only a few degrees of phase margin are often possible. Even if some transient ringing is acceptable in the closed-feedback loop response, the main concerns are PSRR and noise. A huge peak in the transfer function comes so that the filtering capabilities of the continuous time regulator are lost for particular loading conditions to make the situation barely acceptable. In the following, it is briefly discussed where this problem comes from.

Stability means following a very coarse strategy to keep the device transconductance sufficiently small, unless a large compensating cap insert. A feature that cannot be exploited here is the dominant pole at the internal node corresponding to the gate of the output transistor Mreg.

Referring to the embodiment shown in FIG. 2, starting the loop gain analyses from the regulated gate of the output transistor Mreg, its transconductance, gmout, produces the signal current. This current is entirely driven into the level shift transistor Mls and is collected by the folding element Mfold to go back to the regulated gate of the output transistor Mreg. In this way, the transconductance gmout exclusively determines the entire loop transconductance and no degrees of freedom are left to the designer for a change. This aspect becomes even more troublesome once Miller compensation is adopted. This is usually the case because the output cannot be the dominant pole. At moderately high loads, the transconductance gmout of the output transistor Mreg is much larger than the transconductance of the level shifter Mls, hence it results gmout/Cc for GBW and gmout/Cload as the second pole. This means that stability must be mostly played on making a very large compensating capacitor and relying on a poor phase margin.

However in practical implementations, a zero-nulling resistor in series with the compensation cap helps, but it must be handled with care as it can cause instability in the case of large load currents and light load caps.

Figure 4A:
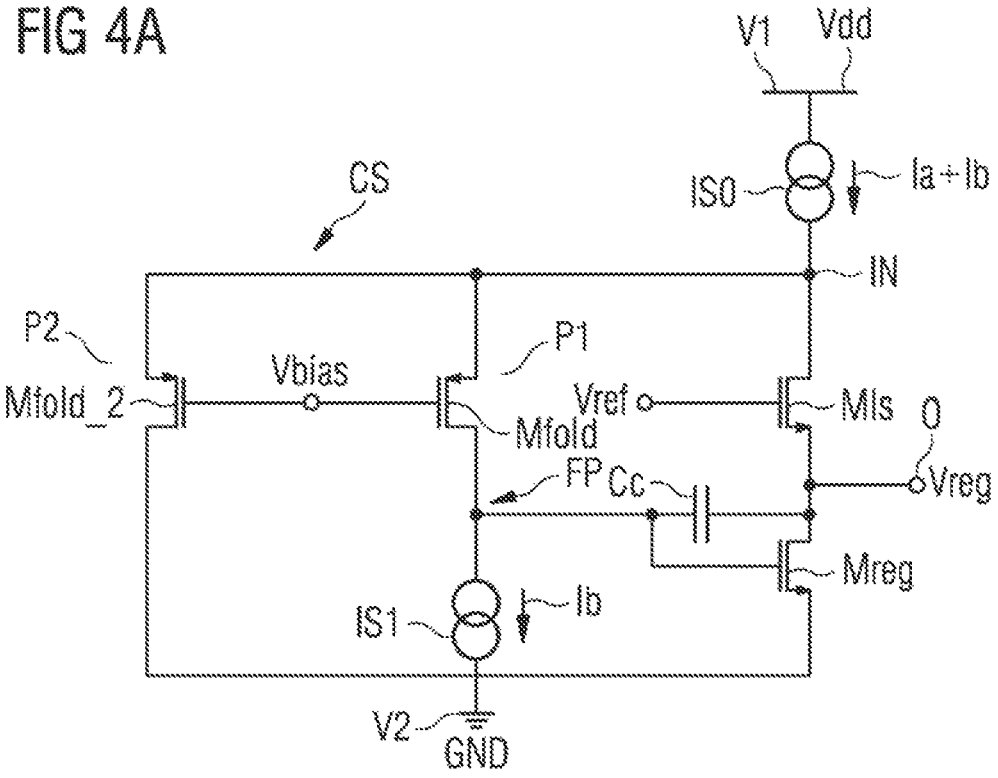
FIG. 4A shows an embodiment of a feedback based level shift regulator circuit comprising a current splitter for stability improvement.

FIG. 4A shows an embodiment of a feedback based level shift regulator circuit comprising a current splitter for stability improvement. The circuit comprises the output current path OP including the output transistor Mreg and the level shift transistor Mls which are connected in series in the output current path OP between the input node IN and a ground terminal GND. The gate connection of the level shift transistor is biased by the reference voltage Vref. The dummy diode Mdumm for the Vref level shift is omitted in the drawing only for sake of simplicity. The current source IS0 generates a constant current Ia+Ib that is applied to the input node IN of the output current path. The output voltage Vreg is generated at the output terminal O that is arranged between the source connection of the level shift transistor Mls and the drain connection of the output transistor Mreg. A compensating capacitor Cc is arranged between the gate connection of the output transistor Mreg and the output terminal O.

In contrast to the embodiment of the feedback based level shift regulator circuit shown in FIG. 2, the circuit of FIG. 4A comprises a current splitter CS including two parallel paths P1 and P2 that are arranged in parallel between the input node IN and the ground terminal GND. The current splitter CS comprises a first (folding) transistor Mfold and a second transistor Mfold_2. The second current path P2 comprising the second transistor Mfold_2 of the current splitter is connected between the input node IN and the ground terminal GND.

The first transistor Mfold is arranged in a first of the two parallel paths P1. The drain connection of the first transistor Mfold is coupled via a constant current source IS1 to provide a constant current Ib to the ground potential GND. The drain connection of the first transistor Mfold of the current splitter is, for example directly, connected to the gate connection of the output transistor Mreg. The current path comprising the level shift transistor Mls and the first transistor Mfold of the current splitter CS of which its drain connection is connected to the gate connection of the output transistor Mreg corresponds to the feedback path FP.

The portion Ia of the current provided by the current source IS0 biases the level shift transistor Mls. According to the embodiment of the level shift regulator circuit of FIG. 4A, the splitting path is built at the folding transistor Mfold. The transistors Mfold and Mfold_2 act as a current splitter because they share the gate and the source connection. The second transistor Mfold_2 of the current splitter, matched to the first transistor Mfold of the current splitter is inserted to steer some signal current away from the first path P1, i.e. the feedback path FP. When the current reaches the common source connection of the transistors Mfold and Mfold_2, it is splitted according to the geometrical ratio of the two transistors Mfold and Mfold_2. The signal current is reduced N+1 times, given N the ratio between the aspect ratio of the two devices Mfold and Mfold_2.

The loop gain is built on the current that is generated across the output transistor Mreg, going through the level shift transistor Mls and is then folded across the first transistor Mfold of the current splitter before it reaches the gate connection of the output transistor Mreg. The current across the second transistor Mfold_2 of the current splitter is not driven to the gate connection of the output transistor Mreg, but sunk away to ground GND. Only one of the two parallel paths P1 is arranged to reach the dominant pole, the other discharges the current into a supply rail or a low impedance node outside the loop. This gives a net reduction in the total loop transconductance.

In comparison to the embodiment of the level shift regulator circuit of FIG. 2, the path at the folding element Mfold is split into two parallel paths, wherein one of the two paths P2 is discharged to a low impedance node so that a loose of signal current occurs at the gate connection of the output transistor Mreg and thus a reduction in the loop gain is obtained. As a result, it results a lower gain which is easy to compensate by the compensating capacitor Cc being much smaller than the compensating capacitor Cc of FIG. 2. The circuit shown in FIG. 4A allows to achieve stability with a smaller compensation capacitor Cc than the compensating capacitor Cc of the level shift regulator circuit shown in FIG. 2. The net gain attenuation is obtained to ease stability achievement.

According to a further embodiment of the level shift regulator circuit, it is proposed that the signal current injected into the second parallel path P2 comprising the second transistor Mfold_2 of the current splitter CS is not discharged into a voltage source, but is first inverted and then injected into the dominant pole. In this way, the signal current provided by the first transistor Mfold of the current splitter and the signal current being applied from the current mirror to the gate connection of the output transistor Mreg tend to subtract each other to obtain a further gain reduction.

Figure 4B:
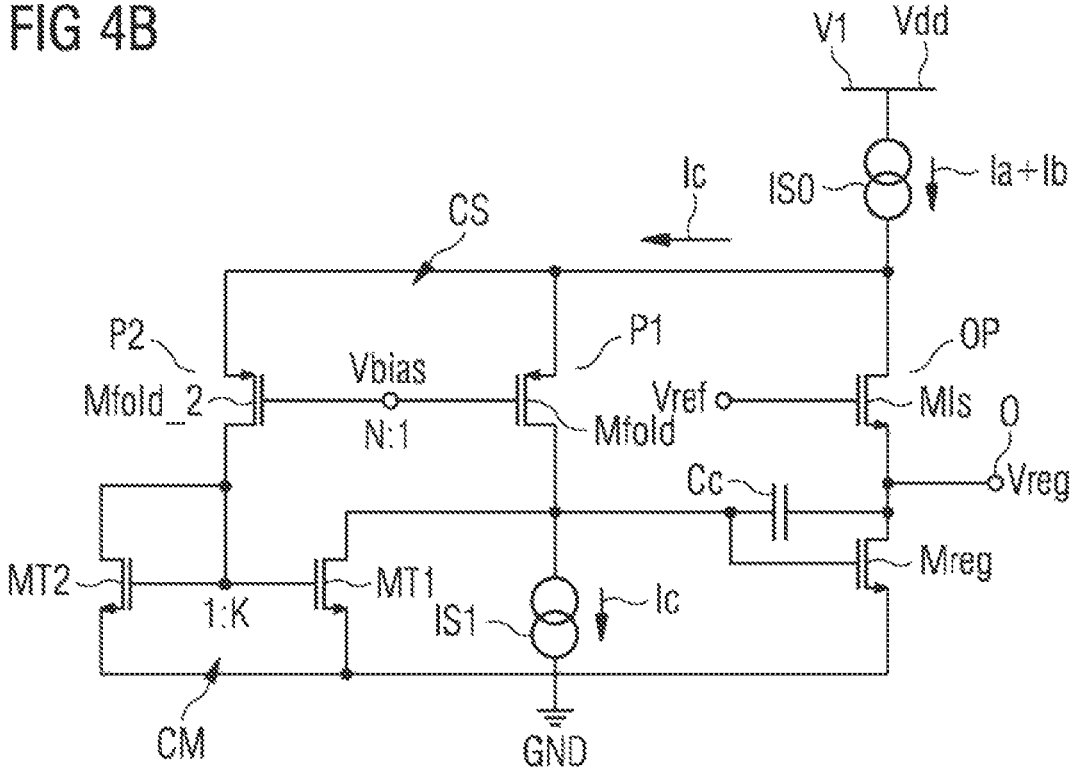
FIG. 4B shows an embodiment of a feedback based level shift regulator circuit comprising a current mirror for further improvement of stability.

FIG. 4B shows a possible circuit arrangement of the level shift regulator comprising a terminal V1 to apply the supply potential Vdd and a current source IS0 to provide a constant current Ia+Ib. The circuit further comprises the level shift transistor Mls being connected to the current source IS0 and the output transistor Mreg being arranged in series to the level shift transistor Mls. The circuit comprises the output node O to provide the output signal Vreg being arranged between the level shift transistor Mls and the output transistor Mreg. The circuit further comprises the current splitter CS to split the current of the current source IS0. The current splitter CS is connected to the gate connection of the output transistor Mreg. The circuit further comprises a current mirror CM being arranged in series to the current splitter CS. The current mirror CM is arranged in the second one of the parallel paths P2 and is coupled to the gate connection of the output transistor Mreg.

The level shift regulator circuit comprises the terminal V2 to apply the ground potential GND and the input node IN to apply the current provided by the current source IS0. The circuit further comprises the output path OP comprising the level shift transistor Mls and the output transistor Mreg. The gate connection of the level shift transistor is biased by a reference voltage Vref. The output path OP is arranged between the input node IN and the terminal V2.

The circuit further comprises a feedback path FP comprising the current splitter CS and the current mirror CM. The feedback path FP is arranged between the input node IN and the gate connection of the output transistor Mreg. The level shift regulator circuit further comprises the current source IS1 being arranged between the gate connection of the output transistor Mreg and the terminal V2 to provide the constant current Ic.

The current splitter CS comprises a first (folding) transistor Mfold and a second (folding) transistor Mfold_2. The first and the second (folding) transistor Mfold, Mfold_2 are connected together at their respective source terminal and at their respective gate terminal. The respective source terminal of the first and second (folding) transistor is connected to the input node IN. The current splitter CS comprises two parallel connected current paths P1, P2. The first (folding) transistor Mfold of the current splitter is arranged in a first one of the two parallel current paths P1 between the input node IN and the current source IS1. The second (folding) transistor Mfold_2 of the current splitter is arranged in a second one of the two parallel paths P2 being connected between the input node IN and the reference terminal V2. The drain connection of the first (folding) transistor Mfold of the current splitter CS is connected to the gate connection of the output transistor Mreg.

The current mirror CM comprises a first transistor MT1 and a second transistor MT2 being coupled together at their respective gate connection. The drain connection of the second (folding) transistor Mfold_2 of the current splitter is connected to the gate terminal of the first and second transistor MT1, MT2 of the current mirror. The drain connection of the second transistor MT2 of the current mirror is directly connected to the gate connection of the second transistor MT2 of the current mirror. The drain connection of the first transistor MT1 of the current mirror CM is connected to the gate connection of the output transistor Mreg. The respective source connection of the first and second transistor Mt1, Mt2 of the current mirror CM is connected to the terminal V2.

The additional current generator IS1 in parallel to the current mirror CM is necessary to avoid a positive feedback loop superior to unity and provide a unique bias to the structure. In comparison to the level shift regulator circuit shown in FIG. 4A, the current steered by the second transistor Mfold_2 of the current splitter CS in the path P2 is not discharged to a low impedance source. However, its current is mirrored and is instead used to cancel or reduce the signal current injected in the dominant pole of the structure to further reduce the loop gain. The current provided by the current mirror CM to the gate connection of the output transistor Mreg is used to cancel part of the signal current provided by the transistor Mfold at the dominant pole of the structure to further reduce the loop gain.

To this purpose, the current mirror Cm injects a current at the drain of the transistor Mfold with a different sign in relation to the signal current provided by the transistor Mfold so that the current provided by the current mirror is subtracted from the signal current provided by the transistor Mfold of the current splitter. In this way the total stage transconductance is further reduced and an even smaller compensating capacitor Cc is sufficient to provide stability.

Bias current in the transistor Mfold will be given by

Ib/(1−KN) while in the transistor Mfold_2 it is N*Ib/(1−KN), wherein K specifies the mirror ratio of the current mirror CM and N specifies the splitter ratio of the current splitter CS. All this considered, two points exist where the signal reduction is possible. In this way the total stage transconductance is very small. It is easy to show that the net transconductance of the stage is gmout*(1−KN)/(N+1).

According to a further embodiment of the level shift regulator circuit, the inserted sections, i.e. the current splitter CS and the mirror CM may be modified to shape the gain vs. frequency. This means to insert zeroes in the transfer function of the circuit to improve the phase response.

Figure 4C:
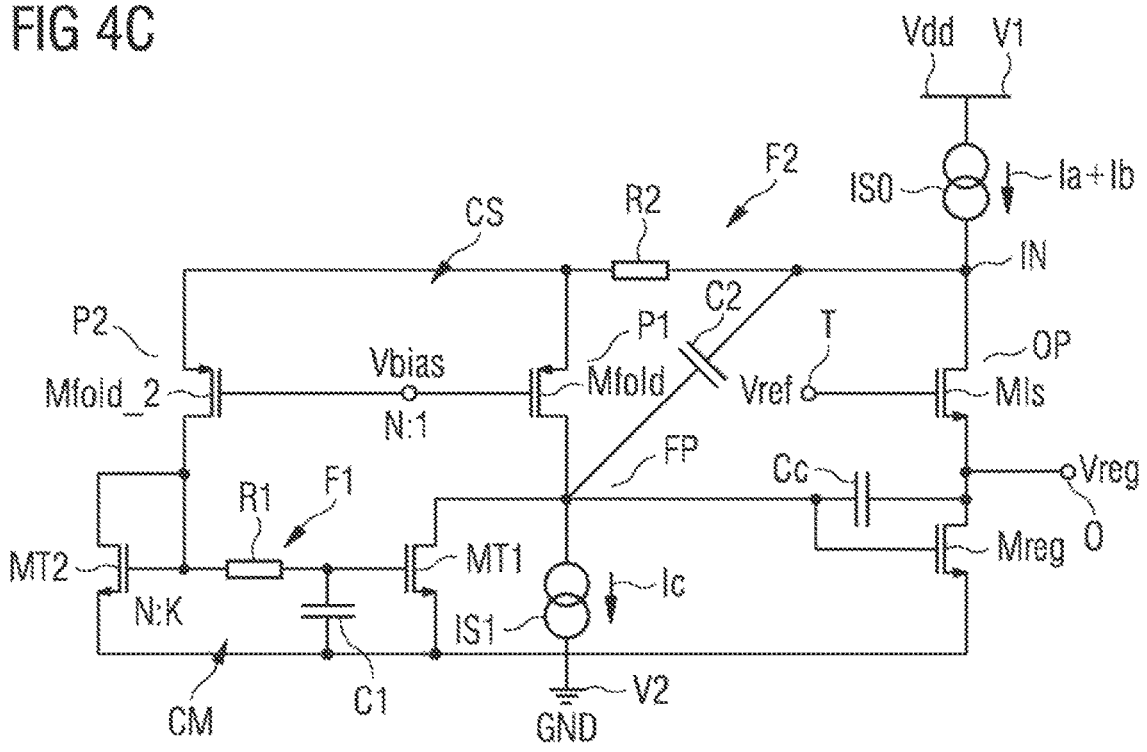
FIG. 4C shows an embodiment of a feedback based level shift regulator circuit comprising filters to provide a large phase margin to further strengthen the stability of the circuit.

FIG. 4C shows another embodiment of a level shift regulator circuit that is based on the circuit shown in FIG. 4B and additionally comprises a first filter F1 and a second filter F2. The first filter F1 is coupled to the current mirror CM to bypass the current mirror. The second filter F2 is coupled to the current splitter CS to bypass the current splitter. Each of the first and second filter F1, F2 may be configured as an RC-filter.

The first filter F1 may comprise a resistor R1 and a capacitor C1. The resistor R1 of the first filter is arranged in a path between the gate connection of the first transistor MT1 of the current mirror and the gate connection of the second transistor MT2 of the current mirror. The capacitor C1 of the first filter is arranged between the gate connection of the first transistor MT1 of the current mirror and the reference terminal V2.

The second filter comprises a resistor R2 and a capacitor C2. The resistor R2 of the second filter is arranged in a current path between the respective source connection of the first and second transistor Mfold, Mfold_2, MT2 of the current splitter CS and the input node IN. The capacitor C2 of the second filter F2 is arranged between the input node IN and the gate connection of the output transistor Mreg.

If focus is directed at the two concerned elements, i.e. the folded transistor Mfold and cascaded mirror CM, we see the drive of one node at low impedance (the source of the folding transistor Mfold) and one at high impedance (the gate of the mirror generator). This lends itself to, respectively, one high and one low frequency scenario.

Once an RC group is added in the current mirror, the signal cancellation/reduction at the gate connection of the output transistor Mreg vanishes and loop gain is boosted at frequency higher than the corresponding cutoff frequency. Considering also that this cap can be ground or supply terminated, unlike the Miller capacitor, area is saved because a MOSFET can be adopted instead of a poly cap.

Gain increase is expected to counteract the phase improvement if we mean to improve phase margin but, as a net result, this trade-off is worth: an important stability improvement is observed for a wide range of possible GBW values around the RC filter cutoff frequency. A variation in the load current varies GBW in a large frequency range, so that it is possible to evaluate the range where the proposed circuit design is effective.

A similar arrangement carried out at the folding element Mfold tends, on the other side, to provide similar achievement in the high frequency range. The resistor R2 is inserted in series to both the folding element Mfold and its dummy Mfold_2, while the capacitor C2 bypasses the part to inject directly in the dominant pole. Remarkably, being the folded pole lightly loaded by capacitors, the use of large resistors is not detrimental for stability. In this way small caps can be used here. In this way the attenuation due to the dummy transistor Mfold_2 is lost at high frequency and another zero in the Bode diagram is obtained. The frequency range where the compensation of the current splitter by the second filter F2 is active is usually dis-overlapped to the one where the RC product at the current mirror CM is effective. In this way no interaction of the parts is possible.

The output transistor Mreg plays the role of the pulldown transistor that guarantees the required sink capability to the structure. The level shift transistor Mls is biased by a fixed current that can be shown to be equal to Ia−Ib*((1+N)/(1−KN)). The gate to source voltage of the level shift transistor does not vary vs. the load current so that the regulated voltage Vreg at the output terminal O is fixed at Vref-Vgs_Mls.

The loop current is, at low frequency, divided by the first and second transistors Mfold, Mfold_2 of the current splitter accordingly to their geometrical size ratio N. Only the current across the transistor Mfold reaches in phase the dominant pole at the gate connection of the output transistor Mreg. On the contrary, the current across the transistor Mfold_2, once NMOS mirrored N:K times, will tend to oppose the one injected by the transistor Mfold. In this way a further gain reduction follows.

The insertion of a former RC group of the resistor R1 and the capacitor C1 at the N:K current mirror CM makes its contribution vanish if the frequency increases above the associated time constant. This makes a stronger current signal at the gate connection of the output transistor Mreg so that a zero is generated in the transfer function of the circuit.

In a similar way, the current splitter CS is bypassed by the second filter F2 realized by the RC group of the resistor R2 and the capacitor C2 so that no signal is lost at the current splitter. In this way another zero in the loop transfer function is generated.

To summary the different design steps shown in FIGS. 4A to 4C, in a first step shown in FIG. 4A, the path at the folding element Mfold shown in FIG. 2 is split into two parallel paths P1, P2, wherein the path P2 is discharged to a low impedance node to reduce loop gain and consequently improve the structure stability.

According to a second step shown in FIG. 4B, the design is modified in that the path P2 is not discharged to a low impedance source: its current, mirrored, is instead used to cancel/reduce the signal current provided by the transistor Mfold and injected in the dominant pole of the structure to further reduce the loop gain.

According to a further step illustrated in FIG. 4C, the addition of a RC net in the second path P2 prevents the gain reduction starting from the RC time constant cut off frequency. In this way a zero is generated in the transfer function of the circuit to improve the phase response. Independent on providing or not providing the first RC filter F1, the second RC filter F2 may be added such that it bypasses the splitter element CS to let the incoming current reach the dominant pole with no attenuation. This provides a zero in the transfer function, starting from the time constant of the second RC filter F2, that improves the phase response of the structure. The same solutions can be applied if replacing the folding element Mfold with the level shift one. The folding element source might replace the high impedance node.

The embodiments of the level shift regulator circuits shown in FIGS. 4B and 4C comprise the current source IS0 to provide the current Ia+Ib and further comprise the current source IS1 being arranged between the gate connection of the output transistor Mreg and the terminal V2 to provide the constant current Ic. Ia is the portion of the current that biases the level shift transistor Mls. The current mirror ratio K and the split ratio N and the current Ic have to be set in such a way that the sum of the currents across the transistors Mfold and Mfold_2 equals the current portion Ib to still have the current portion Ia across the level shift transistor Mls like in the embodiment shown in FIG. 4A.

The combined action of the two blocks, i.e. the current splitter CS and the current mirror CM ensures a low frequency smaller gain to make an improvement in the loop stability. This solves the problem affecting the level shift regulator circuits shown in FIGS. 1 to 3, where there is no degree of freedom to separate the transconductance of the output transistor Mreg that is required to be large to bring the second pole at high frequency from the total loop one, which is desired conveniently smaller for a better phase margin. At the same time, the presence of the two Filters F1 and F2 adds zeroes in the loop transfer function. As a result, the associated positive phase shift improves the loop phase margin.

The embodiments of the level shift regulator circuit presented in FIGS. 4A to 4C are focused on a voltage regulator where the regulated voltage is GND referenced with sinking capability and no load capacitor is provided. However, most of the proposed solutions can be easily extended to other topologies having source drive capability and/or providing supply referenced references.

Figure 5:
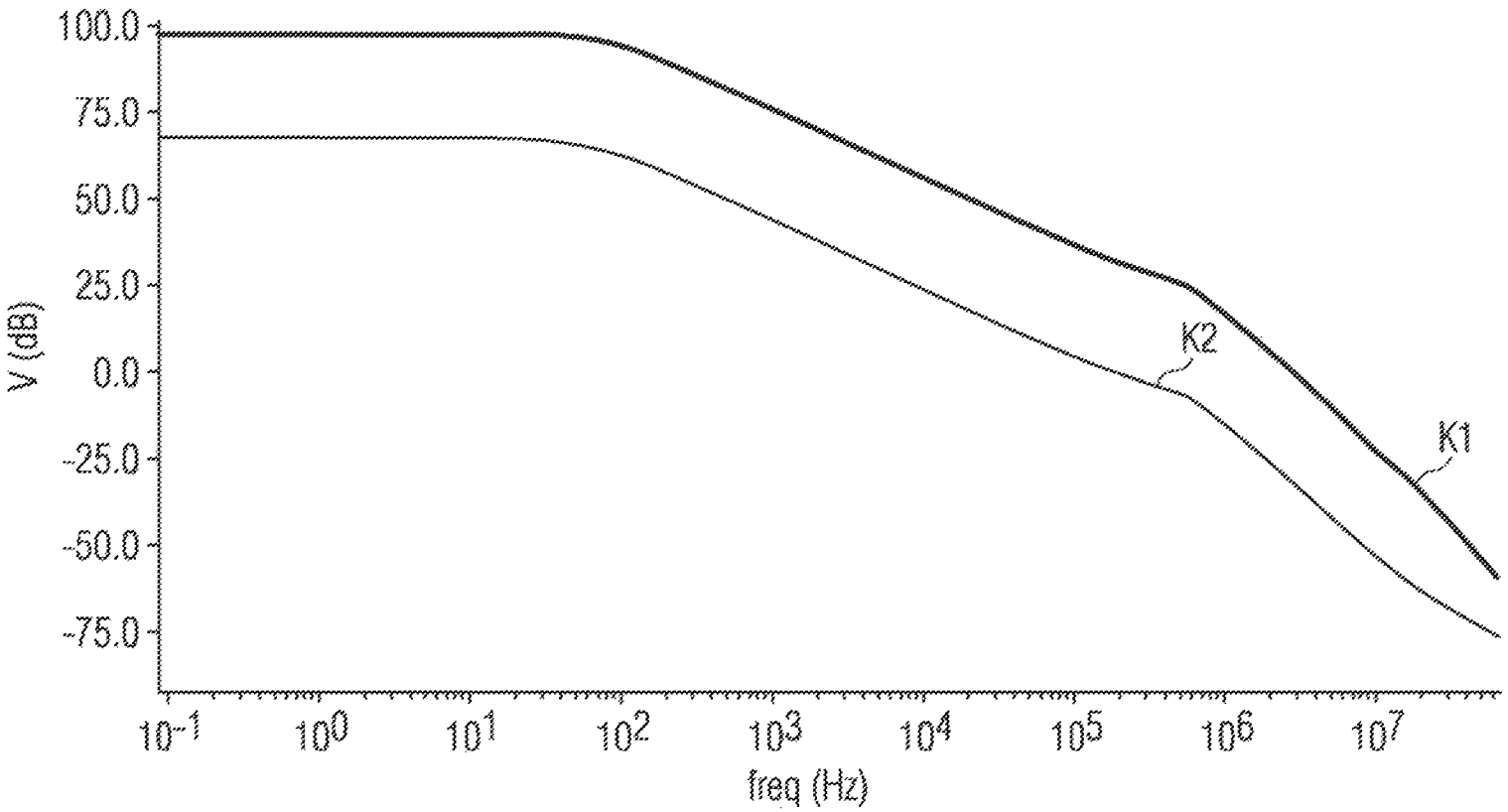
FIG. 5 illustrates the variation of the loop gain after the insertion of the current splitter and the current mirror in the design of the level shift regulator circuit.

FIG. 5 illustrates the variation of the loop gain after the insertion of the current splitter CS and the current mirror CM in the design of the level shift regulator circuit shown in FIG. 4B. The diagram illustrates how the arrangement of the level shifter of FIG. 4*b* is capable to reduce the total loop gain. The curve K1 results from the circuit shown in FIG. 2 while the curve K2 results from the circuit modified as shown in FIG. 4B. It is evident also how the output pole is left unchanged so that higher separation between GBW and the second pole is obtained.

Figure 6:
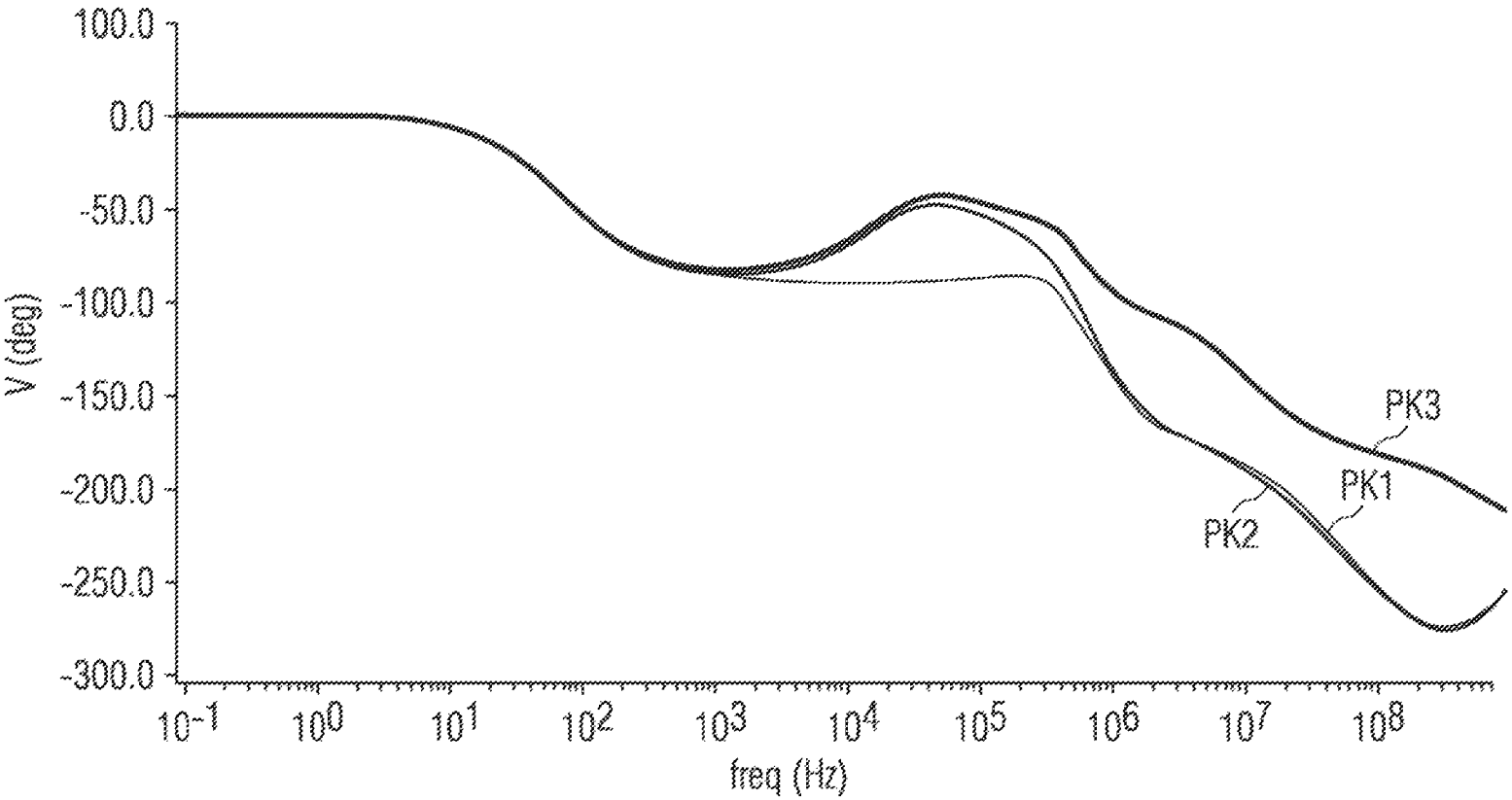
FIG. 6 illustrates the variation of the phase response after the insertion of the filters in the design of the level shift regulator circuit.

FIG. 6 illustrates the variation of the phase response after the insertion of the filters F1 and F2 in the design of the level shift regulator circuit shown in FIG. 4C. The filter F1 at the current mirror CM is responsible of a large phase shift in the low frequency range. As illustrated in the diagram of FIG. 6, the curves moves from the curve PK1 to the curve PK2 while the filter F2 at the folding element Mfold produces the same effect in an higher frequency range. As illustrated in FIG. 6, the phase response changes from the curve PK2 to the curve PK3.

Figure 7:
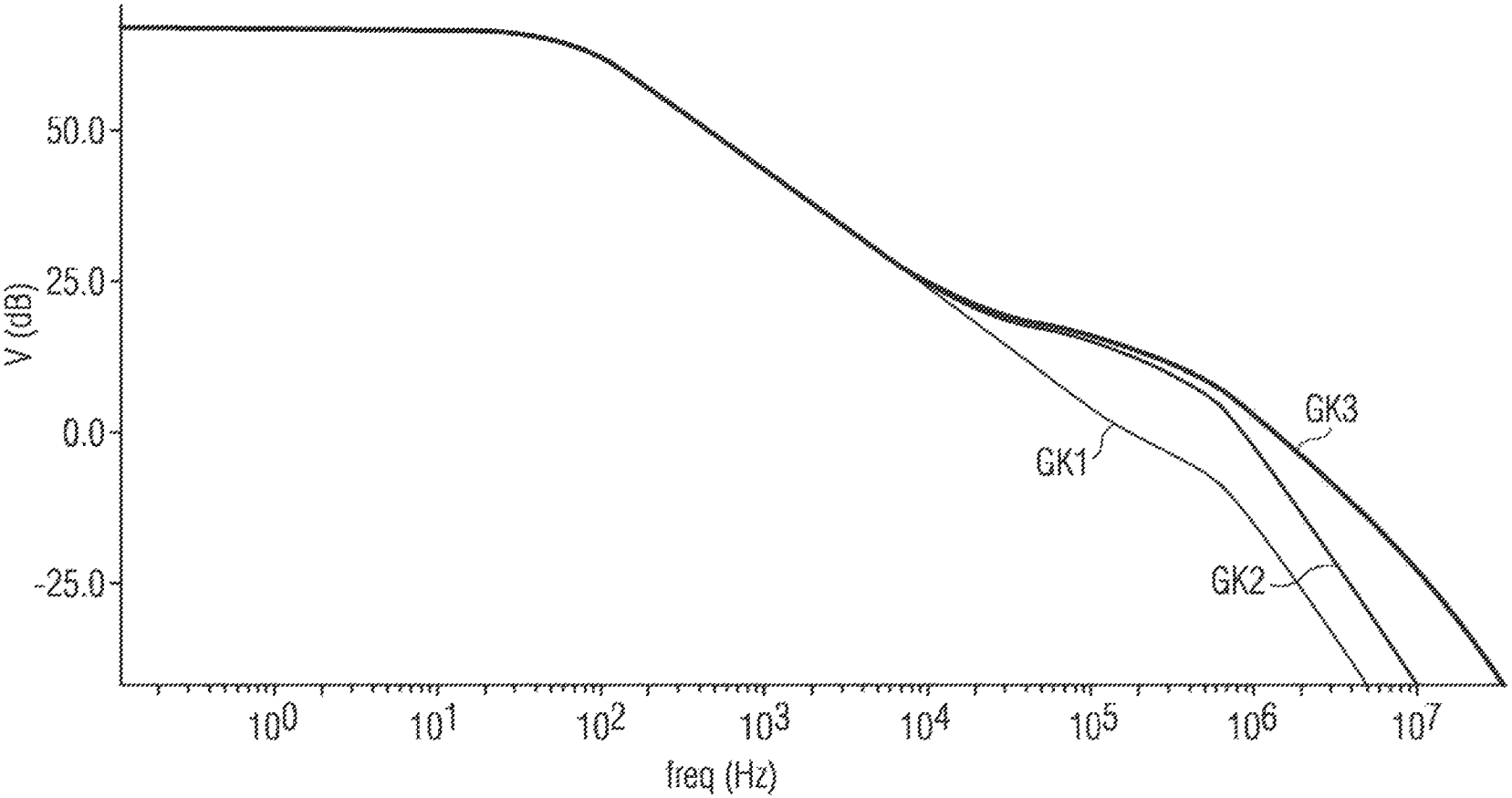
FIG. 7 illustrates the variation of the loop gain after the insertion of the filters in the design of the level shift regulator circuit.

FIG. 7 illustrates the variation of the loop gain after the insertion of the filters F1 and F2 in the design of the level shift regulator circuit shown in FIG. 4C. The loop gain is increased after the addition of the Filters F1 and F2. The curve GK1 illustrates the loop gain for the embodiment of the level shifter shown in FIG. 4B having no filters. The curve GK2 is obtained after the insertion of the filter F1 at the current mirror CM while the curve GK3 shows how the curve GK2 is modified after the insertion of the filter F2 at the folding element Mfold.

Figure 8:
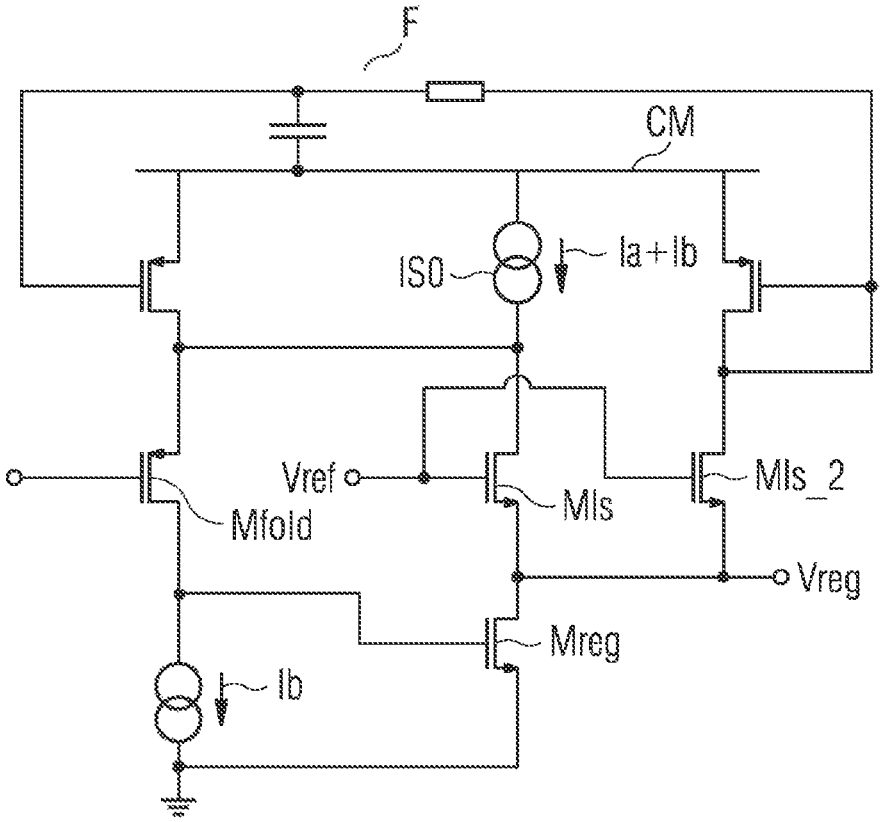
FIG. 8 shows an embodiment of a feedback based level shift regulator circuit using the current splitter, the current mirror and a filter based on the structure of the feedback based level shift regulator circuit illustrated in FIG. 3.

FIG. 8 shows an embodiment of a level shift regulator circuit, wherein the concept of the present invention is applied to the circuit structure shown in FIG. 3. According to the circuit design of FIG. 3, the parallel device Mls_2 shown in FIG. 3 has been inserted for superior drive capability but also it splits the signal current and reduces the loop gain.

In comparison to the level shift regulator circuit shown in FIG. 3, the improved circuit shown in FIG. 8 has been modified by adding a current mirror CM and a filter F being configured as an RC group. However, this approach is not as effective as the circuit shown in FIG. 4C. Since it is responsible for the load capacitor cut-off, inserting series resistors for feed-forward compensation is not welcome. Furthermore, unlike the folding element whose current is always limited by the current generator IS0, the additional level shift transistor Mls_2 transient current might vary a lot. The dominant pole would be affected by large signal transients whose consequences must be carefully studied for a safe application. The reason why the level shift transistor Mls is not the best place to put the RC filter F is that the resistance of the resistor R should be small to be crossed by large current. So the capacitance of the capacitor C should be too large and a lot of area would be wasted.

This means that this kind of solution shown in FIG. 8 can be still thought as a means to accomplish similar goal (even if it has been conceived for other aims, i.e. to obtain symmetrical current drive capability, and stability improvement looks just a collateral benefit) but it is not as effective and flexible as the concept shown in FIG. 4C. Moreover, it is not considered that its mirrored current can be used for signal cancellation to obtain further GBW reduction.

LIST OF REFERENCE SIGNS

V1 terminal to apply supply potential
V2 terminal to apply ground potential
IS0, IS1 current source
IN input node
OP output path
Mls level shift transistor
Mreg output transistor
Vreg output voltage
O output terminal
Mfold first (folding) transistor of current splitter
Mfold_2 second transistor of current splitter
CS current splitter
CM current mirror
Cc compensating capacitor
MT transistors of current mirror
F filters
FP feedback path

The invention claimed is:

1. A level shift regulator circuit, comprising:

a terminal to apply a supply potential, a current source to provide a constant current, a level shift transistor being connected to the current source, an output transistor being arranged in series to the level shift transistor, a current splitter to split the current of the current source, wherein the current splitter is connected to the gate connection of the output transistor, a current mirror being arranged in series to the current splitter, wherein the current mirror is coupled to the gate connection of the output transistor, a terminal to apply a ground potential, and an input node to apply the current provided by the current source, wherein the current splitter comprises a first transistor and a second transistor, wherein the first and second transistors of the current splitter are connected together at their respective source terminals and at their respective gate terminals, wherein the respective source terminals of the first and second transistors of the current splitter is connected to the input node, wherein the current splitter comprises two parallel connected current paths, wherein the first transistor of the current splitter is arranged in a first one of the two parallel current paths between the input node and the current source, wherein the second transistor of the current splitter is arranged in a second one of the two parallel current paths being connected between the input node and the terminal to apply the ground potential.

2. The level shift regulator circuit as claimed in claim 1, comprising:

an output path comprising the level shift transistor and the output transistor, wherein the output path is arranged between the input node and the terminal to apply the ground potential, a feedback path comprising the current splitter and the current mirror, wherein the feedback path is arranged between the input node and the gate connection of the output transistor.

3. The level shift regulator circuit as claimed in claim 1, wherein the drain connection of the first transistor of the current splitter is connected to the gate connection of the output transistor.

4. The level shift regulator circuit as claimed in claim 1, wherein the current mirror comprises a first transistor and a second transistor being coupled together at their respective gate connections, wherein the drain connection of the second transistor of the current splitter is connected to the gate terminal of the first and second transistors of the current mirror, wherein the drain connection of the second transistor of the current mirror is directly connected to the gate connection of the second transistor of the current mirror.

5. The level shift regulator circuit as claimed in claim 1, comprising:

a first filter being coupled to the current mirror to bypass the current mirror.

6. The level shift regulator circuit as claimed in claim 1, comprising:

a second filter being coupled to the current splitter to bypass the current splitter.

7. The level shift regulator circuit as claimed in claim 2, comprising:

another current source being arranged between the gate connection of the output transistor and the terminal to apply the ground potential.

8. The level shift regulator circuit as claimed in claim 2, an output terminal to provide an output signal being arranged between the level shift transistor and the output transistor, a compensating capacitor being arranged between the gate connection of the output transistor and the output terminal of the level shift regulator circuit.

9. The level shift regulator circuit as claimed in claim 4, wherein the drain connection of the first transistor of the current mirror is connected to the gate connection of the output transistor.

10. The level shift regulator circuit as claimed in claim 4, wherein the respective source connection of the first and second transistor of the current mirror is connected to the terminal to apply the ground potential.

11. The level shift regulator circuit as claimed in claim 5, wherein the first filter comprises a resistor and a capacitor, wherein the resistor of the first filter is arranged in a path between the gate connection of the first transistor of the current mirror and the gate connection of the second transistor of the current mirror, wherein the capacitor of the first filter is arranged between the gate connection of the first transistor of the current mirror and the terminal to apply the ground potential.

12. The level shift regulator circuit as claimed in claim 6, wherein each of the first and second filter is configured as an RC-filter.

13. The level shift regulator circuit as claimed in claim 6, wherein the second filter comprises a resistor and a capacitor, wherein the resistor of the second filter is arranged in a current path between the respective source connection of the first and second transistor of the current mirror and the input node, wherein the capacitor of the second filter is arranged between the input node and the gate connection of the output transistor.

* * * * *